US011322300B2

(12) United States Patent
Na et al.

(10) Patent No.: US 11,322,300 B2
(45) Date of Patent: May 3, 2022

(54) METHOD FOR MANUFACTURING A CORE FOR A CURRENT TRANSFORMER

(71) Applicant: AMOSENSE CO., LTD, Cheonan-si (KR)

(72) Inventors: Won-San Na, Seoul (KR); Jin-Pyo Park, Seoul (KR); Young-Joon Kim, Gimpo-si (KR); Jae-Jun Ko, Seoul (KR); Su-Hyeoung Tak, Gimpo-si (KR)

(73) Assignee: AMOSENSE CO., LTD, Chungcheongnam-Do (KR)

( * ) Notice: Subject to any disclaimer, the term of this patent is extended or adjusted under 35 U.S.C. 154(b) by 328 days.

(21) Appl. No.: 16/344,584

(22) PCT Filed: Oct. 24, 2017

(86) PCT No.: PCT/KR2017/011755
§ 371 (c)(1),
(2) Date: Apr. 24, 2019

(87) PCT Pub. No.: WO2018/080129
PCT Pub. Date: May 3, 2018

(65) Prior Publication Data

US 2020/0335276 A1 Oct. 22, 2020

(30) Foreign Application Priority Data

Oct. 27, 2016 (KR) ..... 10-2016-0141240

(51) Int. Cl.
*H01F 7/06* (2006.01)
*H01F 41/02* (2006.01)
(Continued)

(52) U.S. Cl.
CPC ..... *H01F 41/0213* (2013.01); *H01F 1/15308* (2013.01); *H01F 27/24* (2013.01)

(58) Field of Classification Search
CPC .... H01F 2038/305; H01F 27/24; H01F 27/25; H01F 41/0213; H01F 1/15308; H01F 1/15333
See application file for complete search history.

(56) References Cited

U.S. PATENT DOCUMENTS 5,069,731 A * 12/1991 Yoshizawa ..... H01F 27/25 148/305
6,348,275 B1 * 2/2002 DeCristofaro ..... H01F 1/15333 428/800

(Continued)

FOREIGN PATENT DOCUMENTS

CN 104451071 A 3/2015
CN 105428053 A 3/2016

(Continued)

OTHER PUBLICATIONS

CN104451071 English Translation.
CN105428053 English Translation.
CN106024321 English Translation.

*Primary Examiner* — Paul D Kim
(74) *Attorney, Agent, or Firm* — CL Intellectual LLC

(57) ABSTRACT

Provided are a core for a current transformer and a manufacturing method for the same in which high permittivity is formed in order to optimize electric power acquisition efficiency by magnetic induction at a low current. The provided method of manufacturing a core through the steps of winding a metal ribbon, heat treating a core base, impregnating, cutting and polishing, wherein after the core base which is inserted into a mold is heat treated to implement a shape, the core base separated from the mold is heat treated to manufacture the core for the current transformer having high permittivity.

6 Claims, 15 Drawing Sheets

(51) Int. Cl.
*H01F 1/153* (2006.01)
*H01F 27/24* (2006.01)

(56) References Cited

U.S. PATENT DOCUMENTS

| | | | | |
|---|---|---|---|---|
| 2006/0000525 | A1* | 1/2006 | Naoe | H01F 1/15308 148/304 |
| 2008/0196795 | A1* | 8/2008 | Waeckerle | H01F 1/153 148/540 |
| 2014/0028431 | A1* | 1/2014 | Lee | H01F 41/0233 336/212 |
| 2015/0343525 | A1* | 12/2015 | Lee | H02K 15/0012 164/118 |
| 2019/0180932 | A1* | 6/2019 | Han | H01F 27/24 |

FOREIGN PATENT DOCUMENTS

| | | | | | |
|---|---|---|---|---|---|
| CN | 106024321 | A | | 10/2016 | |
| CN | 107779562 | A | * | 3/2018 | |
| JP | 56134725 | A | * | 10/1981 | H01F 41/0233 |
| JP | 60182120 | A | * | 9/1985 | H01F 41/0226 |
| JP | 9-27412 | A | | 1/1997 | |
| JP | 2000-232014 | A | | 8/2000 | |
| KR | 2005-0021709 | A | | 3/2005 | |
| KR | 10-0494250 | B1 | | 6/2005 | |
| KR | 10-1505873 | B1 | | 3/2015 | |

* cited by examiner

| TEMPERATURE / ITEMS | 530°C | 540°C | 550°C |
|---|---|---|---|
| MAGNETIC PERMEABILITY AFTER HEAT TREATMENT | 51,800 | 51,700 | 48,100 |
| MAGNETIC PERMEABILITY AFTER IMPREGNATION | 24,700 | 24,900 | 25,700 |
| Δ u | -52.3% | -51.8% | -46.6% |

| TEMPERATURE / ITEMS | 530°C | 540°C | 550°C | 560°C |
|---|---|---|---|---|
| MAGNETIC PERMEABILITY AFTER HEAT TREATMENT | 92,600 | 77,000 | 67,700 | 51,600 |
| MAGNETIC PERMEABILITY AFTER IMPREGNATION | 43,300 | 55,400 | 58,300 | 45,300 |
| Δ u | -53.2% | -28.0% | -13.2% | -12.3% |

| | HEAT TREATMENT L [uH] | IMPREGNATION L [uH] | ΔL [%] | Permeability, μ |
|---|---|---|---|---|
| 1 | 84,900 | 65,500 | -22.9 | 64,200 |
| 2 | 68,400 | 51,100 | -25.0 | 50,100 |
| 3 | 68,400 | 59,000 | -13.7 | 57,900 |
| 4 | 68,400 | 54,000 | -16.6 | 52,900 |
| 5 | 71,300 | 58,300 | -18.2 | 57,200 |
| 6 | 74,100 | 59,700 | -19.4 | 58,600 |
| 7 | 72,000 | 59,000 | -18.0 | 57,900 |
| 8 | 69,100 | 52,500 | -24.0 | 51,500 |
| 9 | 68,400 | 56,100 | -17.9 | 55,000 |
| 10 | 68,400 | 57,600 | -15.8 | 56,500 |
| **Avg.** | **71,300** | **57,600** | **-19.1** | **56.180** |
| Max. | 84,900 | 65,500 | -25.0 | 64,200 |
| Min. | 64,800 | 51,100 | -13.7 | 50,100 |

FIG. 9

| | AFTER HEAT TREATMENT | AFTER IMPREGNATION | AFTER CUTTING | AFTER POLISHING |
|---|---|---|---|---|
| 1 | 68,000 | 51,000 | 8,900 | 16,600 |
| 2 | 68,000 | 59,000 | 6,700 | 20,300 |
| 3 | 65,000 | 54,000 | 9,000 | 26,500 |
| 4 | 71,000 | 58,000 | 9,400 | 21,700 |
| 5 | 74,000 | 60,000 | 12,700 | 20,800 |
| **Avg.** | **69,100** | **56,100** | **9,500** | **21.600** |
| Max. | 74,000 | 60,000 | 12,700 | 26,500 |
| Min. | 65,000 | 51,000 | 6,700 | 16,600 |

FIG. 12

| | 530°C | 540°C | 550°C |
|---|---|---|---|
| Permeability, u | 18,700 | 18,200 | 18,700 |
| $B_m$(T) | 1.2 | 1.2 | 1.2 |
| $H_C$(A/m) | 8.4 | 3.1 | 2.8 |
| $B_r/B_m$(%) | 65.4 | 57.7 | 54.8 |

FIG. 13

METHOD FOR MANUFACTURING A CORE FOR A CURRENT TRANSFORMER

CROSS-REFERENCE TO RELATED APPLICATIONS

This application is a National Stage of International patent application PCT/KR2017/011755, filed on Oct. 24, 2017, which claims priority to foreign Korean patent application No. KR 10-2016-0141240, filed on Oct. 27, 2016, the disclosures of which are incorporated by reference in their entirety.

FIELD OF THE INVENTION

Exemplary embodiments of the present invention relate to a core for a current transformer and a manufacturing method for the same, and more particularly, to a core for a current transformer, which is mounted on the current transformer installed on an electric power line so as to acquire electric power and sense a current using a magnetic induction phenomenon, and a manufacturing method for the same.

BACKGROUND

Recently, as the interest in an electric power supply method using a magnetic induction phenomenon is increasing, various types of magnetic induction electric power supply devices have been developed.

The magnetic induction electric power supply device includes a current transformer installed on an electric power line through which a large current flows, such as a transmission line, a distribution line, or the like. The magnetic induction electric power supply device converts electric power acquired in the current transformer through a magnetic induction phenomenon into a direct-current (DC) to supply the DC to a load.

In this case, in order to acquire electric power through the magnetic induction phenomenon, the current transformer includes a core for surrounding the electric power line and a coil configured to be wound around the core.

Generally, a core for a current transformer is manufactured through a winding process, a heat treatment process, and a cutting process.

However, as a conventional core for a current transformer undergoes the heat treatment process and the cutting process, there is a problem in that magnetic permeability of the conventional core for a current transformer is degraded to about 3000.

When the magnetic permeability of the core for a current transformer is formed of 3000 and normal electric power flows in an electric power line, electric power required for a load can be acquired. However, when a low current flows in the electric power line, electric power acquisition efficiency is degraded such that there is a problem in that the electric power required for the load cannot be acquired.

Further, as the magnetic permeability is degraded, inductance of the core for a current transformer is reduced such that there is a problem in that the electric power acquisition efficiency is degraded when the core for a current transformer is mounted on a current transformer.

Consequently, when the low current flows in the electric power line, the core for a current transformer cannot acquire electric power such that there is a problem in that required electric power cannot be acquired.

SUMMARY OF THE INVENTION

An object of the present invention is to provide a core for a current transformer, which is capable of forming high permittivity so as to optimize electric power acquisition efficiency through magnetic induction at a low current, and a manufacturing method for the same.

That is, the objective of the present disclosure is to provide a method of manufacturing a core for a current transformer, which is capable of improving electric power acquisition efficiency at a low current by forming a shape through primary heat treatment within a set temperature range, performing secondary heat treatment at a temperature that is higher than that of the primary heat treatment within the set temperature range, and forming a high permittivity characteristic through impregnating, cutting, and polishing.

In accordance with one aspect of the present invention, a method of manufacturing a core for a current transformer includes winding a metal ribbon to manufacture a core base, performing heat treatment on the core base at a set temperature, impregnating the heat-treated core base into an impregnation solution, cutting the core base impregnated into the impregnation solution to manufacture a core, and machining a cut surface of the core through polishing.

In accordance with another aspect of the present invention, a core for a current transformer includes an upper core which is formed such that both ends of a semi-cylindrical-shaped base extend downward and in which an accommodating groove is formed, and a lower core formed such that both ends of a base extend in a direction of the upper core, wherein each of the upper core and the lower core has magnetic permeability of 20000 or more. Each of the upper core and the lower core may be formed of a nanocrystalline ribbon made of an Fe-based magnetic alloy.

In accordance with a core for a current transformer and a manufacturing method for the same according to the present disclosure, the core for a current transformer is manufactured by performing heat treatment on a core base at a set temperature and then performing impregnating, cutting, and surface machining (i.e., polishing) such that there is an effect of being capable of manufacturing the core for a current transformer having high permittivity of 20000 or more and maximizing electric power acquisition efficiency through magnetic induction at a low current.

Further, in accordance with a core for a current transformer and a manufacturing method for the same according to the present disclosure, a shape is formed through primary heat treatment in a state in which the core base is inserted into a mold, and then the core base is separated from the mold to undergo secondary heat treatment such that there is an effect in that magnetic permeability of the heat-treated core base can be formed over a set value (e.g., 40000) as compared with a related are in which a core base is heat-treated in a state of being inserted into a mold.

BRIEF DESCRIPTION OF THE DRAWINGS

FIG. 2 is a diagram for describing winding of a metal ribbon of FIG. 1.

FIGS. 3 to 6 are diagrams for describing heat treatment of FIG. 1.

FIGS. 7 to 9 are diagrams for describing a core base which undergoes the heat treatment and impregnation of FIG. 1.

FIGS. 10 to 12 are diagrams for describing cutting and cut surface machining of FIG. 1.

FIGS. 13 and 14 are diagrams for describing an optimal heat treatment condition in the method for manufacturing a core for a current transformer according to the embodiment of the present disclosure.

DETAILED DESCRIPTION

Figure 1:
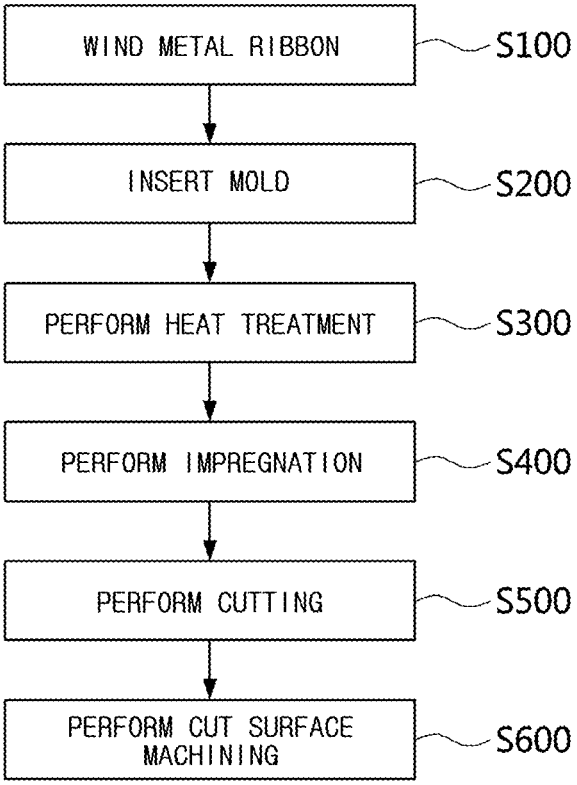
FIG. 1 is a diagram for describing a method of manufacturing a core for a current transformer according to an embodiment of the present disclosure.

Hereinafter, most preferred embodiments of the present disclosure will be described in detail with reference to the accompanying drawings in order to facilitate a person skilled in the art to easily practice the technical spirit of the present disclosure. In giving reference numerals to components of the drawings, the same reference numerals are given to the same components even when the same components are shown in different drawings. Further, in the following description of the present disclosure, if a detailed description of related known configurations or functions is determined to obscure the gist of the present disclosure, the detailed description thereof will be omitted.

Referring to FIG. 1, a method of manufacturing a core for a transformer manufactures a core for a current transformer of high permittivity through winding a metal ribbon (S100), inserting a mold 20 (S200), heat treatment (S300), impregnation (S400), cutting (S500), and machining a cut surface (S600).

In the winding of the metal ribbon (S100), a metal ribbon having a predetermined thickness and a predetermined width is wound. For example, in the winding of the metal ribbon (S100), two rollers are disposed to be spaced apart from each other, and the metal ribbon is wound through the two rollers to manufacture a core base 10. That is, in the winding of the metal ribbon (S100), the core base 10 is manufactured through a rolling technique.

For example, the metal ribbon is a nanocrystalline ribbon. A thin plate made of a Fe-based magnetic alloy may be used as the nanocrystalline ribbon, and an alloy satisfying the following Formula 1 may be used as the Fe-based magnetic alloy.

$$Fe_{100-c-d-e-f-g}A_cD_dE_eSi_gB_gZ_h \quad \text{[Formula 1]}$$

In Formula 1, A denotes at least one element selected from Cu and Au, D denotes at least one element selected from Ti, Zr, Hf, V, Nb, Ta, Cr, Mo, W, Ni, Co, and rare earth elements, E denotes at least one element selected from Mn, Mn, Al, Ga, Ge, In, Sn, and a platinum group element, Z denotes at least one element selected from C, N, and P, c, d, e, f, g, and h satisfy relational expressions of $0.01 \le c \le 8$ at %, $0.01 \le d \le 10$ at %, $0 \le e \le 10$ at %, $10 \le f \le 25$ at %, $3 \le g \le 12$ at %, and $15 \le f+g+h \le 35$ at %, respectively, and an area ratio of 20% or more in an alloy structure is formed of a fine structure with a particle diameter of 50 nm or less.

A Fe—Si—B—Cu—Nb alloy may be used in preparation of the nanocrystalline ribbon. In this case, Fe may be in the range of 73 to 80 at %, the sum of Si and B may be in the range of 15 to 26 at %, and the sum of Cu and Nb may be in the range of 1 to 5 at %. An amorphous alloy with such a composition range may be easily precipitated into a nanocrystalline by heat treatment which will be described below.

Figures 2, 3:
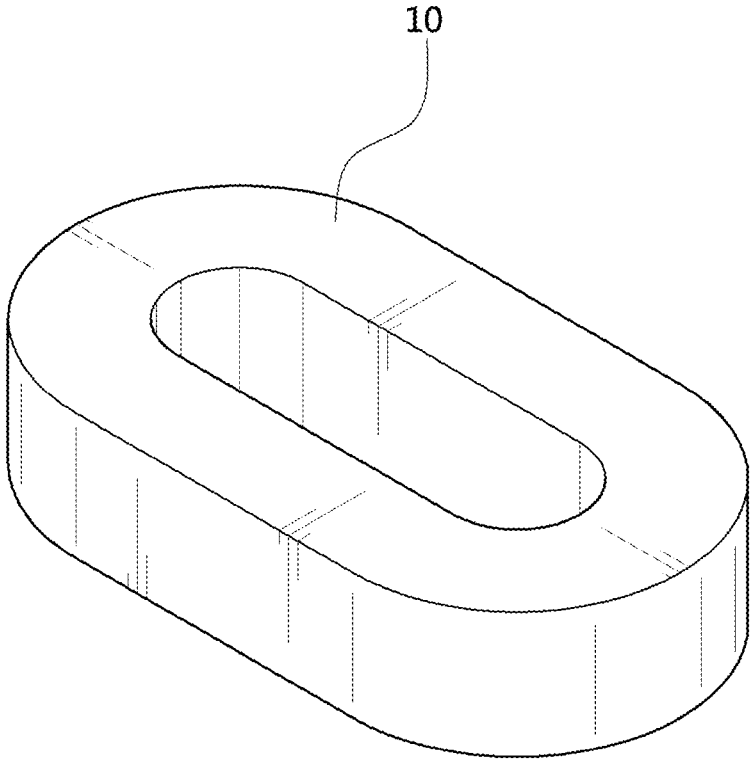

In the winding of the metal ribbon (S100), a rectangular parallelepiped core base 10 having both ends formed in a semi-cylindrical shape is manufactured. Referring to FIG. 2, a rectangular parallelepiped-shaped groove with both ends formed in a semi-cylindrical shape is formed in the core base 10 so that a cross section of the core base 10 is formed in an elliptical shape.

Alternatively, in the winding of the metal ribbon (S100), the core base 10 (that is, the core base 10 having a cross section of an elliptical shape) may be manufactured by winding a metal ribbon on a rectangular parallelepiped-shaped mold 20 with both ends formed in a semi-cylindrical shape.

In the winding of the metal ribbon (S100), when the metal ribbon is wound and thus an air gap is formed therebetween, magnetic permeability of a core is reduced.

Thus, in the winding of the metal ribbon (S100), the metal ribbon is wound through rolling to minimize the formation of the air gap between the metal ribbons such that a reduction in magnetic permeability is prevented and thus degradation in core characteristic is prevented.

In the inserting of the mold 20 (S200), the core base 10 manufactured in the winding of the metal ribbon (S100) is inserted into the mold 20. With the above-described operation, during heat treatment and impregnation of the core base 10, shape deformation of core base 10 is prevented.

In the heat treatment (S300), the core base 10 manufactured in the winding of the metal ribbon (S100) is heat-treated. That is, in the heat treatment (S300), heat is applied to the core base 10 to uniform a density of the core base 10 and keep a saturation induction characteristic thereof constant.

In the heat treatment (S300), heat treatment is performed such that heat having a temperature within a set temperature range is applied to the core base 10 inserted in the mold 20 (a jig). In this case, in the heat treatment (S300), heat having a temperature within a set temperature range of about 530° C. to 550° C. is applied to the core base 10.

In the heat treatment (S300), when the core base 10 undergoes the heat treatment in a state of being inserted into the mold 20, the heat which should be applied to the core base 10 is absorbed by the mold 20 so that the heat treatment is not properly performed.

The magnetic permeability of the core base 10 was measured in a state in which the core base 10 was inserted into the mold 20, and the measured result was shown in FIG. 3.

Referring to FIG. 3, the magnetic permeability of the core base 10 was formed in the range of about 48100 to 51800 dues to an influence of the mold 20.

Generally, when the impregnation (S400) and the cutting (S500), which will be described below, are performed, the magnetic permeability is degraded due to an inductance drop phenomenon, and the magnetic permeability of the core base 10 undergoing the heat treatment (S300) should be formed of about 40000 or more in consideration of degradation in magnetic permeability.

That is, in order to acquire electric power even at a low current, magnetic permeability of a final core should be formed of about 20,000 or more. Therefore, in consideration of degradation in magnetic permeability in the cutting (S500), the magnetic permeability of the core base 10 undergoing the impregnation (S400) should be formed of about 40000 or more.

However, when heat treatment was performed at a temperature of about 530° C., the magnetic permeability of the core base 10, which undergone heat treatment in the state of being inserted into the mold 20, was formed of approximately 51800, and when the heat treatment was performed at a temperature of about 540° C., the magnetic permeability of the core base 10 was formed of approximately 51700, and when the heat treatment was performed at a temperature of about 550° C., the magnetic permeability of the core base 10 was formed of approximately 48100.

In this case, when the core base 10 was heat-treated and impregnated in the state of being inserted into the mold 20, degradation in magnetic permeability occurred in the range of about 46.6% to 52.6% according to a heat treatment temperature such that the magnetic permeability of the core base 10 was formed of about 24700, 24900, or 25700 according to the heat treatment temperature.

Figure 4:
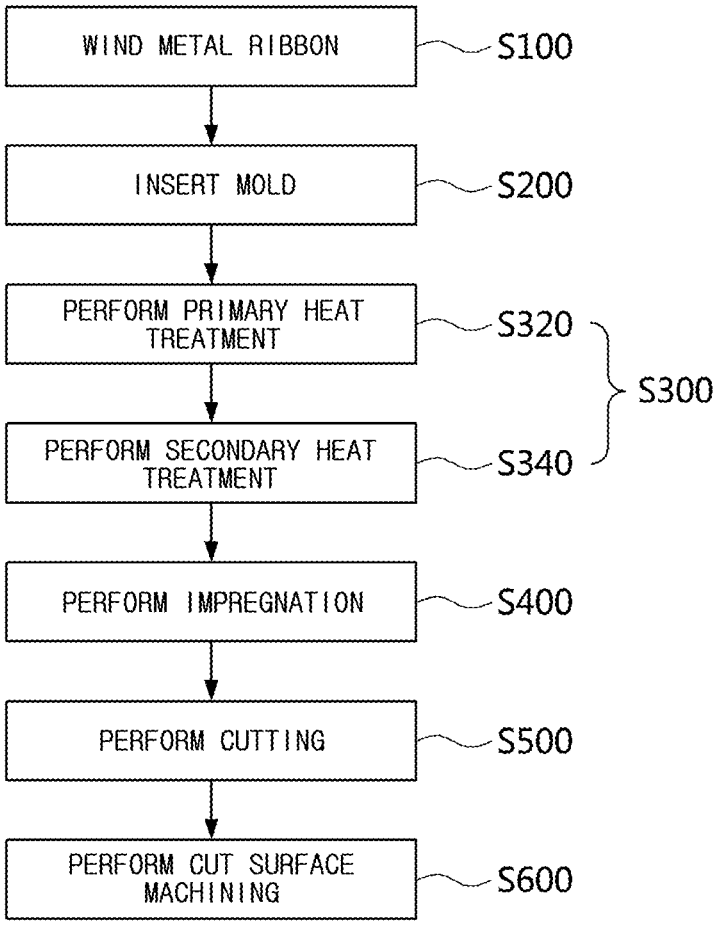

Referring to FIG. 4, in order to form the magnetic permeability of the core base 10 undergone the impregnation (S400) of about 40,000 or more, the core base 10 is heat-treated through primary heat treatment (S320) and secondary heat treatment (S340) of the heat treatment (S300).

Figure 5:
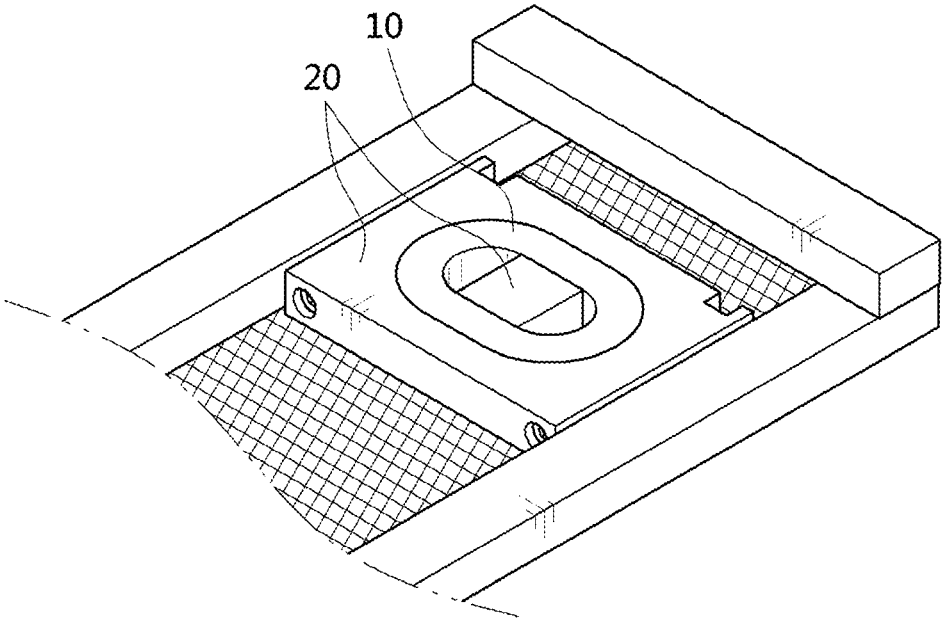

Referring to FIG. 5, in the primary heat treatment (S320), in order to form the shape of the core base 10, heat having a first set temperature is applied to the core base 10 inserted into the mold 20 for a first set time, thereby forming the shape of the core base 10. Here, the first set time is set to about 30 minutes or less, and the first set temperature is set in the range of about 530° C. to 540° C.

Figures 6, 7:
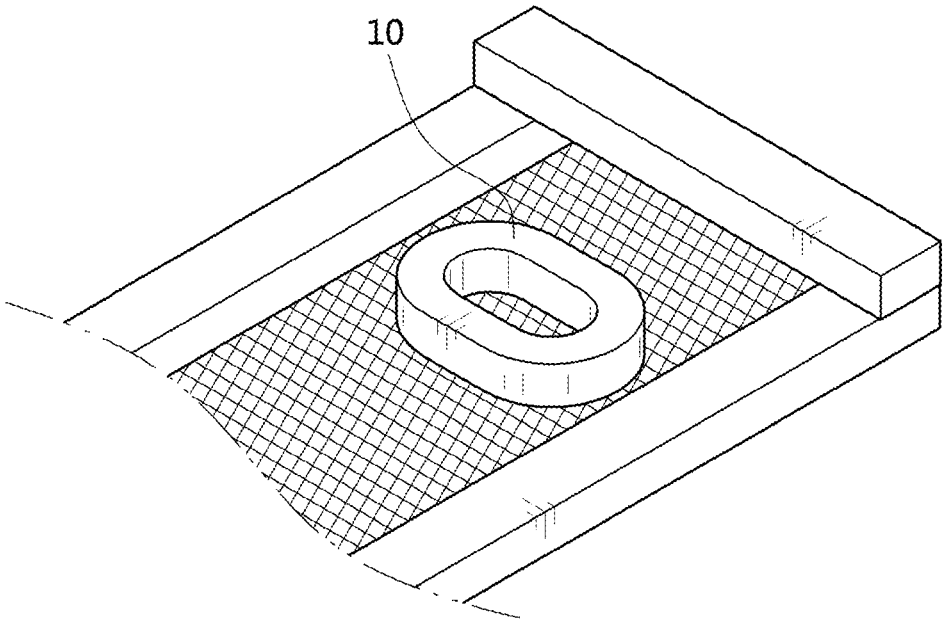

Referring to FIG. 6, in the secondary heat treatment (S340), in order to implement a magnetic characteristic (i.e., magnetic permeability) of the core base 10, heat having a second set temperature is applied to the core base 10 removed from the mold 20 for a second set time, thereby implementing the magnetic characteristic of the core base 10. In this case, the second set temperature may be set to a temperature that is higher than the first set temperature, and the second set time may be set to a time that is longer than the first set time. Here, the second set time is set in the range of about 30 to 90 minutes, and the second set temperature is set in the range of about 530° C. to 560° C.

For example, in the first heat treatment (S320), heat having a temperature of about 540° C. is applied to the core base 10 inserted into the mold 20 for about 30 minutes, thereby forming the shape of the core base 10. In the second heat treatment (S340), heat having a temperature of about 550° C. is applied to the core base 10 removed from the mold 20 for about 90 minutes, thereby implementing the shape of the core base 10.

In the impregnation (S400), the core base 10 undergoing heat treatment is impregnated into an impregnation liquid. That is, in the impregnation (S400), the core base 10 is impregnated into the impregnation liquid (e.g., a varnish impregnation liquid) to minimize an air gap of the core base 10. Consequently, in the impregnation (S400), the core base 10 having magnetic permeability in the range of about 40000 to 60000 is formed.

Figure 8:
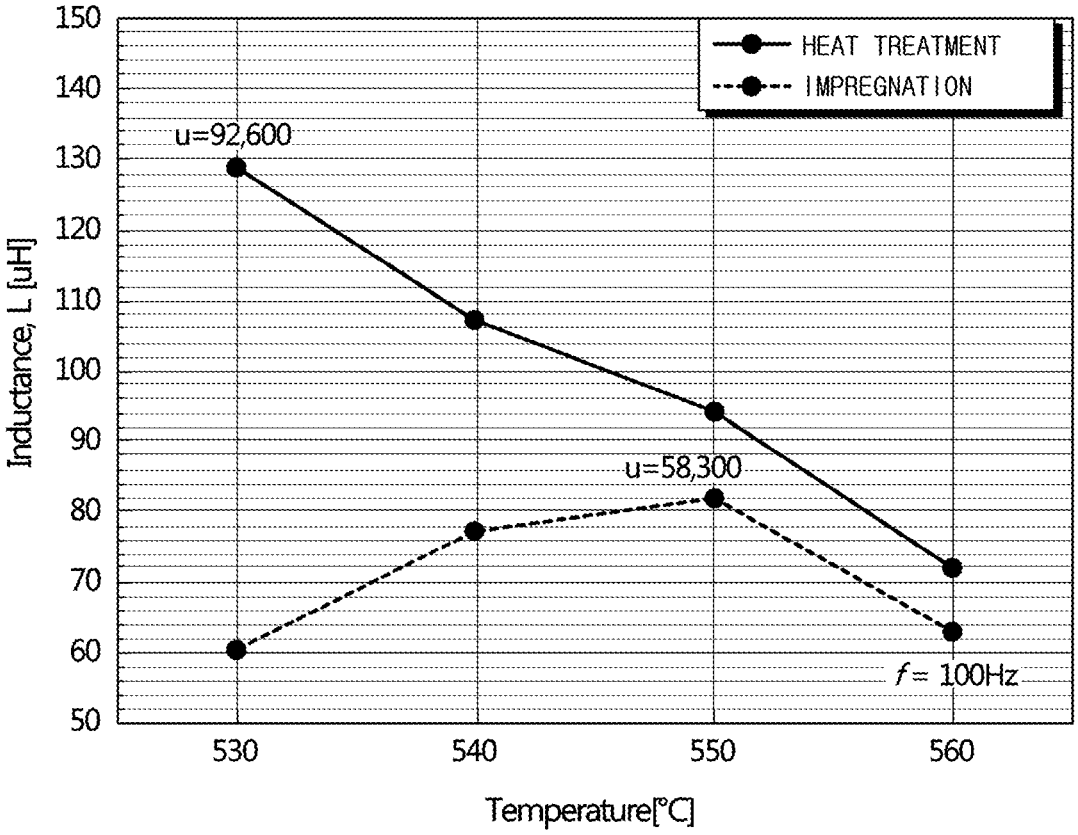

The magnetic permeability of the core base 10 undergoing the heat treatment through the first heat treatment (S320) and the second heat treatment (S340), and the magnetic permeability of the core base 100 undergoing the impregnation (S400) were measured, and the measured results were shown in FIGS. 7 and 8.

Referring to FIG. 7, in the second heat treatment (S340), the magnetic permeability of the core base 10 undergoing heat treatment at a temperature of about 530° C. was formed of about 92600, the magnetic permeability of the core base 10 undergoing the heat treatment at a temperature of about 540° C. was formed of about 77000, the magnetic permeability of the core base 10 undergoing the heat treatment at a temperature of about 550° C. was formed of about 67700, and the magnetic permeability of the core base 10 undergoing the heat treatment at a temperature of about 560° C. was formed of about 51600.

Thereafter, the magnetic permeability of the core base 10 undergoing the impregnation (S400) was formed of about 43300, 55400, 58300, or 45300 according to the heat treatment temperature so that it was confirmed that the magnetic permeability was formed to satisfy a magnetic permeability condition (i.e., about 40000 or more) of the core base 10 undergoing the impregnation (S400).

Meanwhile, referring to FIG. 8, when the core base 10 was heated at a temperature of about 530° C. in the heat treatment (S300), highest magnetic permeability (and inductance) was formed, and, as the heat treatment temperature rises, the magnetic permeability (and inductance) decreases. That is, the core base 10 has the highest magnetic permeability (and inductance) at the heat treatment temperature of 530° C. in the heat treatment (S300), and, as the heat treatment temperature gradually rises to 560° C., the magnetic permeability (and inductance) decreases.

Here, since it is difficult to directly measure the magnetic permeability of the core base 10, inductance of the core base 10 was measured and magnetic permeability calculated using the measured inductance was shown in FIG. 4.

Meanwhile, the magnetic permeability of the core base 10 undergoing the impregnation (S400) is degraded than the magnetic permeability thereof after the heat treatment (S300) due to an inductance drop phenomenon.

In this case, the core base 10 has a different inductance drop rate according to the heat treatment temperature in the heat treatment (S300). That is, as the heat treatment temperature in the heat treatment (S300) rises from 530° C. to 550° C., the magnetic permeability of the core base 10 undergoing the impregnation (S400) increases, whereas, when the heat treatment temperature is equal to or higher than a temperature of 550° C., the magnetic permeability thereof decreases.

This means that, as the heat treatment temperature rises, the inductance drop rate is degraded. Therefore, in consideration of the magnetic permeability and the inductance drop rate of the core base 10 according to the heat treatment temperature, it is possible to manufacture the core base 10 having the highest magnetic permeability when the heat treatment is performed at a temperature of about 550° C.

In consideration of the above-described characteristics, in order to form the core base 10 having the highest magnetic permeability, the heat treatment temperature of the heat treatment (S300) (i.e., the second set temperature) may be set to about 550° C.

In order to confirm the above description, inductance of the core base 10 undergoing the heat treatment (S300) in which the heat treatment temperature (i.e., the second set temperature) is set to about 550° C., and inductance of the core base 10 undergoing the impregnation (S400) after the heat treatment step (S300) were repeatedly measured 10 times, the magnetic permeability was calculated using the measured result, and the calculated magnetic permeability was shown in FIG. 9.

Referring to FIG. 9, average magnetic permeability of the core base 10 undergoing the heat treatment step (S300) and the impregnation step (S400) was formed of about 56180 so that the temperature of about 550° C. was determined as a most ideal heat treatment temperature.

Figure 10:
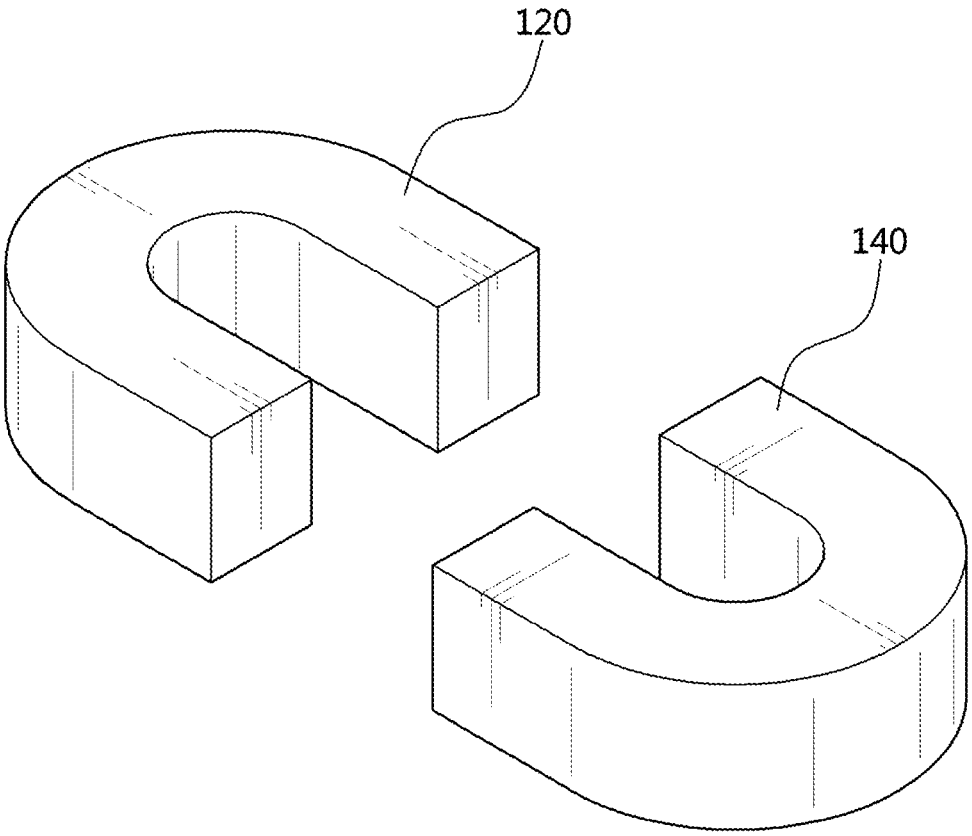

In the cutting (S500), the core base 10 undergoing the heat treatment and the impregnation is cut to manufacture an upper core 120 and a lower core 140. That is, referring to FIG. 10, in the cutting (S500), the core base 10 is cut in a direction perpendicular to that of the winding. In this case, in the cutting (S500), the upper core 120 and the lower core 140 may be manufactured to have the same dimension by cutting a central portion of the core base 10, and alternatively, a position biased to one end of the core base 10 is cut to manufacture the upper core 120 and the lower core 140 which have different dimensions.

In the surface machining (S600), both ends (i.e., cut surfaces) of each of the upper core 120 and the lower core 140, which are manufactured in the cutting (S500), are machined.

Figure 11:
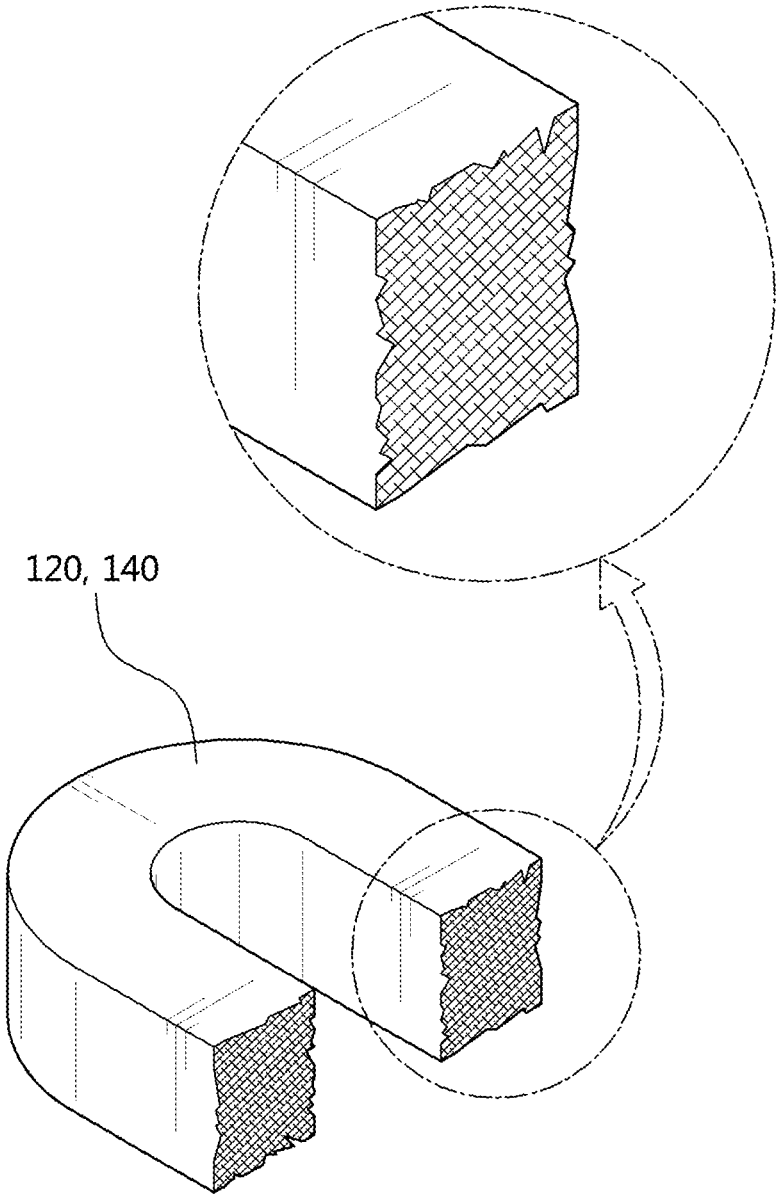

Referring to FIG. 11, the cut surfaces of each of the upper core 120 and the lower core 140, which are cut in the cutting (S500), are formed to be rough. Consequently, when the upper core 120 is coupled to the lower core 140, which are cut in the cutting step (S500), a gap may occur.

In this case, when the upper core 120 and the lower core 140 are mounted on a current transformer in a state in which a gap occurs, voltage acquisition efficiency is degraded due to the gap occurring between the cut surfaces when the upper core 120 is coupled to the lower core 140.

Therefore, in the surface machining (S600), surface machining is performed so as to allow both end faces (i.e., the cut surfaces) of one of the upper core 120 and the lower core 140 to correspond to both end faces of the other one of the upper core 120 and the lower core 140. In this case, in the surface machining (S600), the both end surfaces of each of the upper core 120 and the lower core 140 may be machined through polishing.

The inductance of the core base 10 undergoing the heat treatment (S300) in which the heat treatment temperature (i.e., the second set temperature) is set to about 550° C., the inductance of the core base 10 undergoing the impregnation (S400) after the heat treatment (S300), the inductance of the core base 10 undergoing the cutting (S500), and the inductance of the core base 10 undergoing the surface machining (S600) were each measured, magnetic permeability were calculated using the measured results, and the calculated magnetic permeability were shown in FIG. 12.

Referring to FIG. 12, the magnetic permeability of the core base 10 undergoing the impregnation (S400) was formed of about 50000 or more, whereas, the magnetic permeability of the core, which was cut through the cutting (S500), dropped to about 10000 or less due to influence of the gap occurring between surfaces (i.e., the cut surfaces).

Thus, the magnetic permeability may be improved by reducing the gap between surfaces of the core (i.e., the cut faces in contact with each other) through polishing in the surface machining (S600).

After the surfaces of the core were machined through the surface machining (S600), the magnetic permeability of the core was formed of about 20000 or more. When a constant force is applied to the core through mechanism while the core is mounted on the current transformer, magnetic permeability of about 30000 or more may be implemented.

Figure 14:
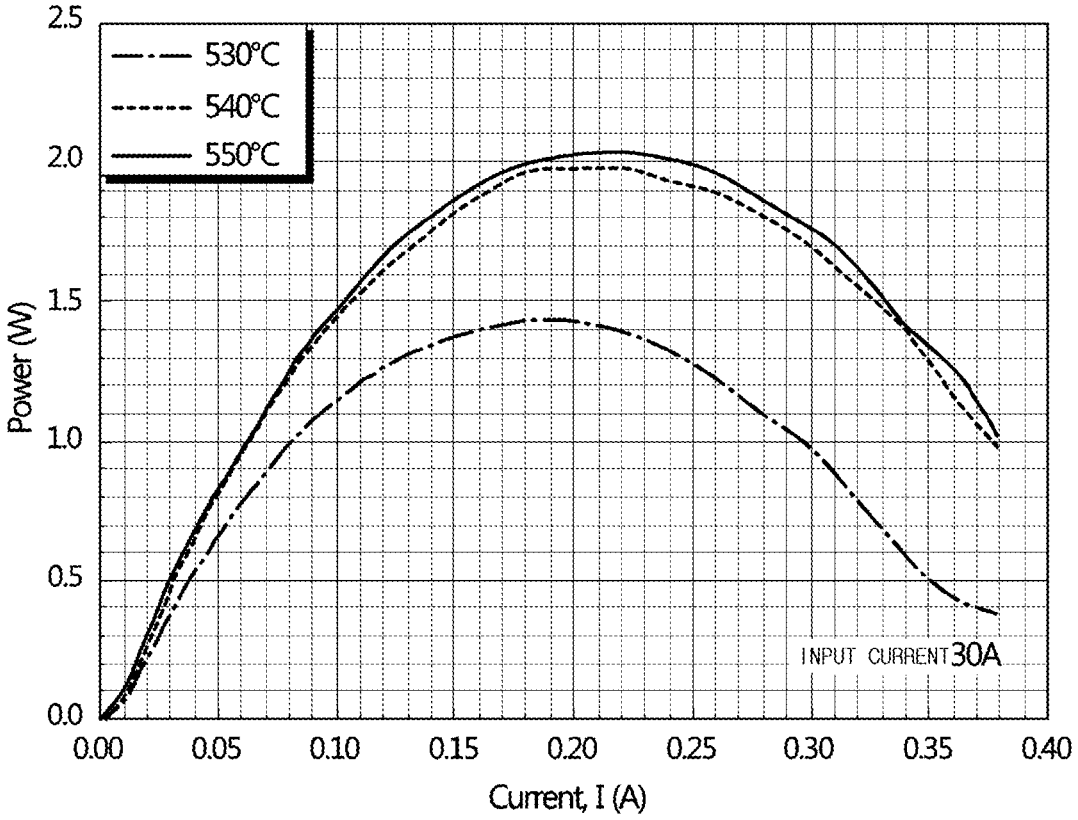

B-H curves of the cores 100 for a current transformer, which were manufactured to have similar magnetic permeability by performing heat treatment at the above-described temperatures of 530° C., 540° C. and 550° C., were measured, and, after each of the cores 100 for a current transformer was mounted on an actual current transformer and in a state in which a low current (e.g., 0.4 A or less) flows in an electric power line, electric power induced from each of the cores 100 for a current transformer was measured, and the measured results were shown in FIGS. 13 and 14.

Referring to FIG. 13, the magnetic permeability of the core 100 for a current transformer undergoing the heat treatment at the temperature of 530° C. was formed of about 18700, the magnetic permeability of the core 100 for a current transformer undergoing the heat treatment at the temperature of 540° C. was formed of about 18200, and the magnetic permeability of the core 100 for a current transformer undergoing the heat treatment at the temperature of 540° C. was formed of about 18700 so that the cores 100 for a current transformer were formed to have similar magnetic permeability. Thereafter, B-H curves of the cores 100 for a current transformer were measured by a measuring device, and, as the measured results, the cores 100 for a current transformer had similar values in magnetic flux density but had different values in coercive force He.

Meanwhile, referring to FIG. 14, among the cores 100 for a current transformer, the core 100 for a current transformer undergoing the heat treatment at the temperature of about 550° C. formed highest electric power induction ratio in a low current state.

This means that, when the magnetic permeability is set to be equal to each other and the coercive force He is formed to be lower, the electric power induction ratio is increased. Therefore, an optimal temperature for manufacturing the core 100 for a current transformer having the highest electric power induction ratio is 550° C.

Figure 15:
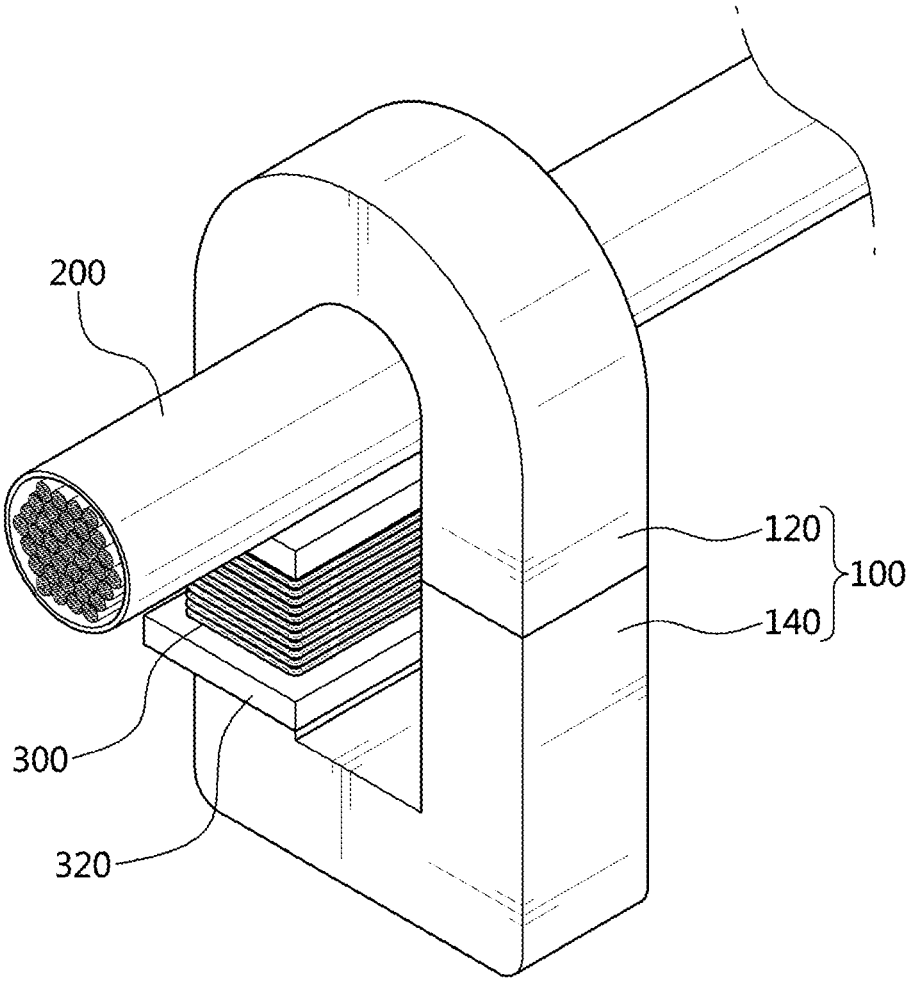
FIG. 15 is a diagram for describing the core for a current transformer according to the embodiment of the present disclosure.

Referring to FIG. 15, the core 100 for a current transformer according to an embodiment of the present disclosure includes the upper core 120 configured to accommodate an electric power line 200 therein, and the lower core 140 on which a bobbin 320 having a coil 300 wound thereon is mounted.

In this case, the core for a current transformer is manufactured by performing heat treatment at a set temperature in the range of about 530° C. to 560° C., and magnetic permeability is formed of about 20000 or more.

The upper core 120 is disposed above the lower core 140, and an accommodating groove 124 in which the electric is accommodated is formed in the upper core 120. The upper core 120 is formed in a shape (e.g., an inverted U-shape) partially surrounding a circumference of the electric wire, thereby minimizing a separation space between the electric power line 200 and the core. In this case, when the electric power line 200 is accommodated in the accommodating groove 124 of the upper core 120, both ends of the upper core 120 are located at positions that are lower than a position of a center of the electric power line 200 (i.e., at positions that are closer to the lower core 140). Consequently, the electric power line 200 is fully accommodated in the accommodating groove 124 formed in the upper core 120.

Figure 16:
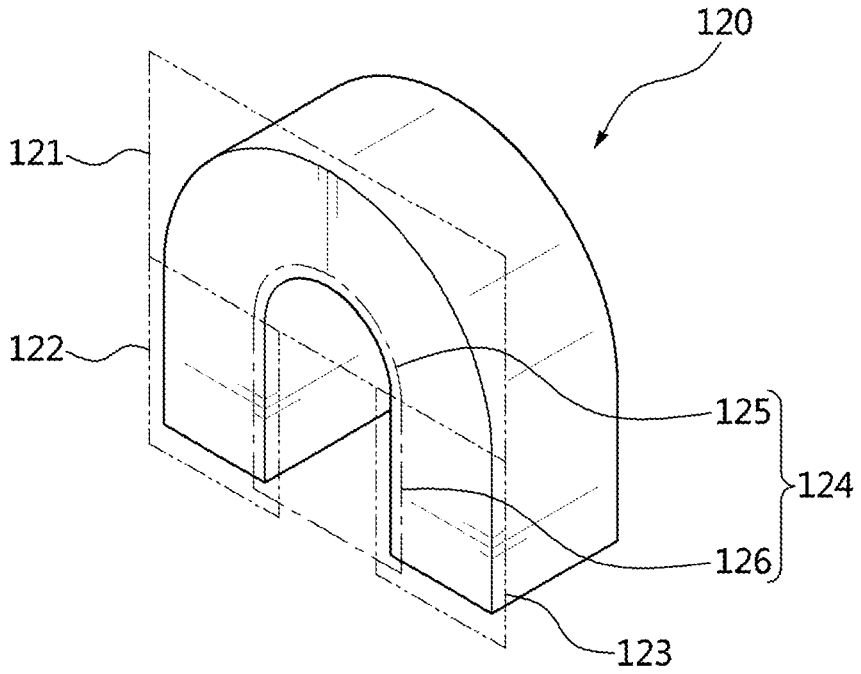
FIG. 16 is a diagram for describing an upper core of FIG. 15.

For example, referring to FIG. 16, the upper core 120 includes an upper base 121, a first upper extension 122, and a second upper extension 123. To easily describe a shape of the upper core 120, the upper core 120 will be described below as being into the upper base 121, the first upper extension 122, and the second upper extension 123. However, the upper core 120 is integrally formed.

The upper base 121 is formed in a semi-cylindrical shape. In this case, a cross section of the upper base 121 may be formed in a quadrangular shape. An upper accommodating groove 125 in which the electric power line 200 is accommodated is formed in a semi-cylindrical shape in the upper base 121. In this case, the upper accommodating groove 125 partially accommodates the electric power line 200 (i.e., a part of a cross section of the electric power line 200).

The first upper extension 122 is formed to extend from one end of the upper base 121 in a downward direction (i.e., a direction of the lower core 140). In this case, a cross section of the first upper extension 122 may be formed in a hexahedron shape that is identical to a shape of the cross section of upper base 121.

The second upper extension 123 is formed to extend from the other end of the upper base 121 in the downward direction (i.e., the direction of the lower core 140). In this case, a cross section of the second upper extension 123 may be formed in a hexahedron shape that is identical to the shape of the cross section of upper base 121.

Meanwhile, as the first upper extension 122 and the second upper extension 123 extend from the both ends of the upper base 121 to be spaced apart from each other, an accommodating groove 126 is formed in a predetermined shape (e.g., a rectangular parallelepiped shape) between the first upper extension 122 and the second upper extension 123. In this case, the lower accommodating groove 126 accommodates the remaining portion of the electric power line 200 except for the portion of the electric power line 200 accommodated in the upper accommodating groove 125.

Consequently, in the upper core 120, the accommodating groove 124 is formed in a structure in which a rectangular parallelepiped-shaped groove is coupled to a lower portion of a semi-cylindrical upper groove. At this time, a half of the electric power line 200 is accommodated in an upper portion of the accommodating groove 124 (i.e., the semi-cylindrical upper groove), and the other half of the electric power line 200 is accommodated in a lower portion of the accommodating groove 124 (i.e., a rectangular parallelepiped-shaped groove).

The lower core 140 is disposed below the upper core 120, and both ends of the lower core 140 are brought into contact with the both ends of the upper core 120. The lower core 140 is formed in a shape in which the upper core 120 is rotated with 180 degrees (e.g., a U shape). In this case, the bobbin 300 on which the coil 320 is wound is mounted on at least one of the both ends of the lower core 140. Here, as one end of the lower core 140 passes through a groove formed in the bobbin 300, the bobbin 300 is mounted on the lower core 140.

Figure 17:
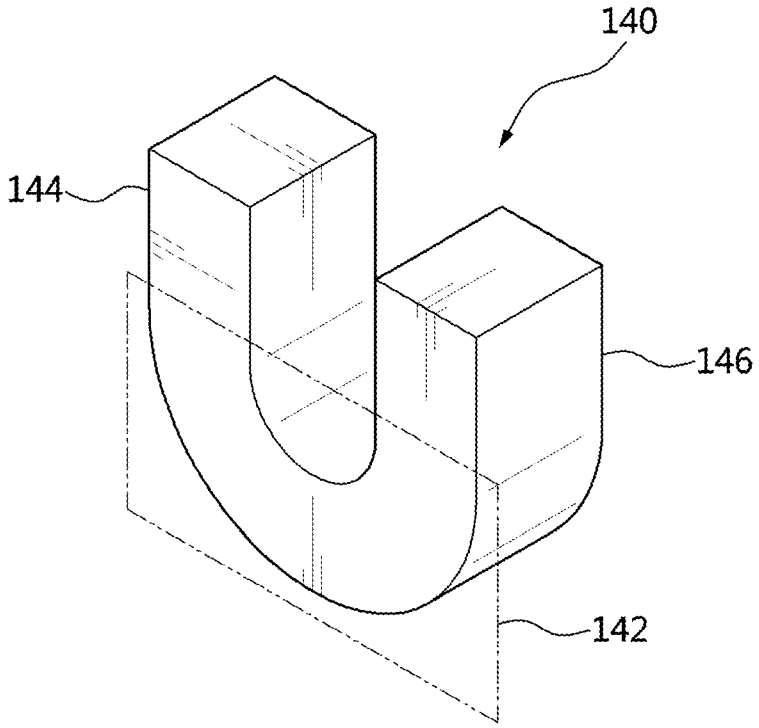
FIGS. 17 and 18 are diagrams for describing a lower core of FIG. 15.

For example, referring to FIG. 17, the lower core 140 includes a lower base 142, a first lower extension 144, and a second lower extension 146. To easily describe a shape of the lower core 140, the lower core 140 will be described below as being into the lower base 142, the first lower extension 144, and the second upper extension 146. However, the lower core 140 is integrally formed.

The lower base 142 is formed in a semi-cylindrical shape. In this case, a cross section of the lower base 142 may be formed in a quadrangular shape.

The first lower extension 144 is formed to extend from one end of the lower base 142 in an upward direction (i.e., a direction of the upper core 120). In this case, a cross section of the first lower extension 144 may be formed in a hexahedron shape that is identical to a shape of the cross section of the lower base 142. The cross section of the first lower extension 144 may be formed in a shape that is identical to the shape of the cross section of the upper core 120.

The second lower extension 146 is formed to extend from the other end of the lower base 142 in the upward direction (i.e., the direction of the upper core 120). In this case, a cross section of the second lower extension 146 may be formed in a hexahedron shape that is identical to a shape of the cross section of the lower base 142. The cross section of the second lower extension 146 may be formed in a shape that is identical to the shape of the cross section of the upper core 120.

In the core 100 for a current transformer, when the bobbin 300 is mounted on the lower core 140 formed in the U shape, a separation space is formed between the lower core 140 and the bobbin 300 such that adhesion between the lower core 140 and the bobbin 300 is degraded.

In addition, in the core 100 for a current transformer, when the bobbin 300 is mounted on the lower core 140 formed in the U shape, the bobbin 300 is not mounted on a round portion (i.e., the lower base 142) such that a size of the bobbin 300 mountable on the lower core 140, is reduced and the number of turns of the coil 320 is decreased due to the reduction in size of the bobbin 300.

Consequently, inductance of the core 100 for a current transformer decreases, and thus an output voltage thereof (i.e., a voltage acquired from the electric power line 200) is decreased.

Thus, the core located at a lower portion of the lower core 140 (i.e., the lower base 142) may be formed in a hexahedron shape, and thus the lower direction may be formed in a straight line shape. That is, since a lower portion of the core 100 for a current transformer is formed in a straight line shape, a size of the bobbin 300 mountable on the lower core 140 is increased, and the number of turns of the coil 320 is increased due to the increase in size of the bobbin 300.

Consequently, the inductance of the core 100 for a current transformer increases, and thus the output voltage thereof (i.e., the voltage acquired from the electric power line 200) is increased.

Figure 18:
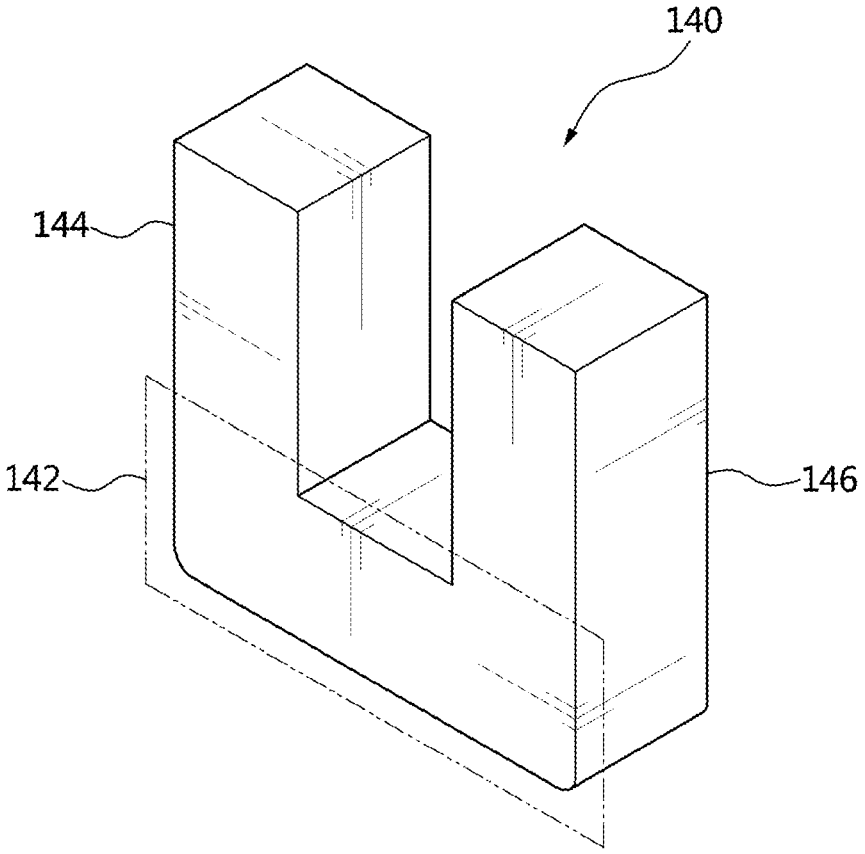

For example, referring to FIG. 18, the lower core 140 includes a lower base 142, the first lower extension 144, and the second lower extension 146 so that the lower core 140 may be formed in an angled C shape.

The lower base 142 is formed in a rectangular parallelepiped shape. In this case, the first lower extension 144 and the second lower extension 146 may be formed in both ends of the lower base 142, and alternatively, the first lower extension 144 and the second lower extension 146 may be formed in both end portions of one surface of lower base 142.

The first lower extension 144 is formed to extend from one end portion of one surface of the lower base 142 in the upward direction (i.e., the direction of the upper core 120). The first lower extension 144 may be formed to extend upward from one end portion of the lower base 142. In this case, a cross section of the first lower extension 144 may be formed in a hexahedron shape that is identical to a shape of a cross section of one end portion of the upper core 120.

The first lower extension 144 is formed in a hexahedron shape. One end of the first lower extension 144 is coupled to one end or one end portion of one surface of the lower base 142, or one end portion of one surface of the first lower extension 144 is coupled to one end or one end portion of one surface of the lower base 142. The other end of the first lower extension 144 (i.e., one end disposed in the upward direction) is brought into contact with one end of the upper core 120.

The second lower extension 146 is formed to extend from the other end portion of one surface of the lower base 142 in the upward direction (i.e., the direction of the upper core 120). The second lower extension 146 may be formed to extend upward from the other end portion of the lower base 142. In this case, a cross section of the second lower extension 146 may be formed in a hexahedron shape that is identical to a shape of a cross section of the other end portion of the upper core 120.

The second lower extension 146 is formed in a hexahedral shape. One end of the first lower extension 146 is coupled to the other end or the other end portion of one surface of the lower base 142, or one end portion of one surface of the first lower extension 146 is coupled to the other end or the other end portion of one surface of the lower base 142. The other end of the second lower extension 146 (i.e., one end disposed in the upward direction) is brought into contact with the other end of the upper core 120.

While the preferred embodiments of the present disclosure have been described, these embodiments can be modified in various forms, and it should be understood by those skilled in the art that various modifications and alternations may be practiced without departing from the scope of the appended claims.

The invention claimed is:

1. A method of manufacturing a core for a current transformer, the method comprising:

winding a metal ribbon to manufacture a core base;

performing a heat treatment on the core base at a set temperature;

impregnating the heat-treated core base into an impregnation solution;

cutting the core base impregnated into the impregnation solution to manufacture the core; and machining a cut surface of the core through polishing, wherein the performing of the heat treatment on the core base includes performing a heat treatment on the core base inserted into a mold at a first set temperature, and performing a heat treatment on the core separated from the mold at a second set temperature.

2. The method of claim 1, wherein the manufacturing of the core base includes winding a nanocrystalline ribbon made of an Fe-based magnetic alloy to manufacture the core base.

3. The method of claim 1, wherein the performing of the heat treatment on the core base further includes setting a temperature in a range of 530° C. to 540° C. as the first set temperature.

4. The method of claim 1, wherein the performing of the heat treatment on the core base further includes setting a temperature in a range of 530° C. to 560° C. as the second set temperature.

5. The method of claim 1, wherein, after the impregnation, magnetic permeability of the core base is formed of 40000 or more.

6. The method of claim 1, wherein, after the machining of the cut surface, magnetic permeability of the core is formed of 20000 or more.

* * * * *